United States Patent [19]

Paparodis

[11] 3,978,331

[45] Aug. 31, 1976

[54] AREA LIGHTING LUMINAIRE

[75] Inventor: Nicholas J. Paparodis, Youngstown, Ohio

[73] Assignee: The Edward J. DeBartolo Corporation, Youngstown, Ohio

[22] Filed: Apr. 14, 1975

[21] Appl. No.: 568,065

[52] U.S. Cl. ..... 240/25; 240/3

[51] Int. Cl.[2] ..... F21S 1/10

[58] Field of Search ..... 240/25, 106, 106.1, 240/11.4 R, 3

[56] References Cited

UNITED STATES PATENTS 3,113,728 12/1963 Boyd ..... 240/106 R 3,353,015 11/1967 Franklin et al. ..... 240/25

*Primary Examiner*—R. L. Moses

*Attorney, Agent, or Firm*—Webster B. Harpman

[57] ABSTRACT

An area lighting luminaire employs a light source such as a mercury lamp and a reflector therefor positioned in a housing of generally rectangular shape which supports a refractor of ovoidal bowl shape in depending relation to the housing and provides a luminous intercepting zone configuration in the bottom of the housing around the refractor. Reflected light from the luminous intercepting zone of the luminaire softens the overall intensity of the light source and improves the effectiveness and appearance of the luminaire.

7 Claims, 4 Drawing Figures

AREA LIGHTING LUMINAIRE

BACKGROUND OF THE INVENTION

1. Field of the Invention:

This invention relates to area lighting luminaires such as are used in street lighting and parking lot lighting as for example around shopping malls.

2. Description of the Prior Art:

Prior structures of this type have employed mercury lamps, sometimes equipped with ovoidal bowl shaped refractors as in U.S. Pat. No. 3,350,556, open bottom refractor skirts as in U.S. Pat. No. 3,766,375 and various combinations of reflectors, refractors and housings therefor as in U.S. Pat. Nos. 3,342,985 and 3,130,923.

This invention discloses a luminaire having a light reflecting area of unique configuration disposed around and about the light source and more particularly the refractor employed therewith.

SUMMARY OF THE INVENTION

An area lighting luminaire such as desirably employed in lighting parking areas and streets or the like comprises a generally rectangular housing, the bottom of which is centrally apertured for the reception and retention of a refractor which is associated with a reflector and a light source such as a mercury lamp positioned within the housing. The sides and the top of the housing are closed and the housing is preferably supported on the free end of an elongated arm which in turn is carried by a support pole. The bottom of the housing is formed in a light reflecting configuration of light reflecting material so as to create a luminous zone about the refractor which acts to seemingly increase the area of the light source when viewed from below.

DESCRIPTION OF THE PREFERRED EMBODIMENT

Figure 3:
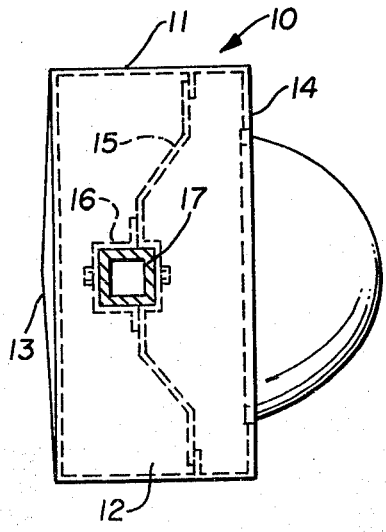
FIG. 3 is an end elevation of the luminaire seen in FIG. 2.
Figure 4:
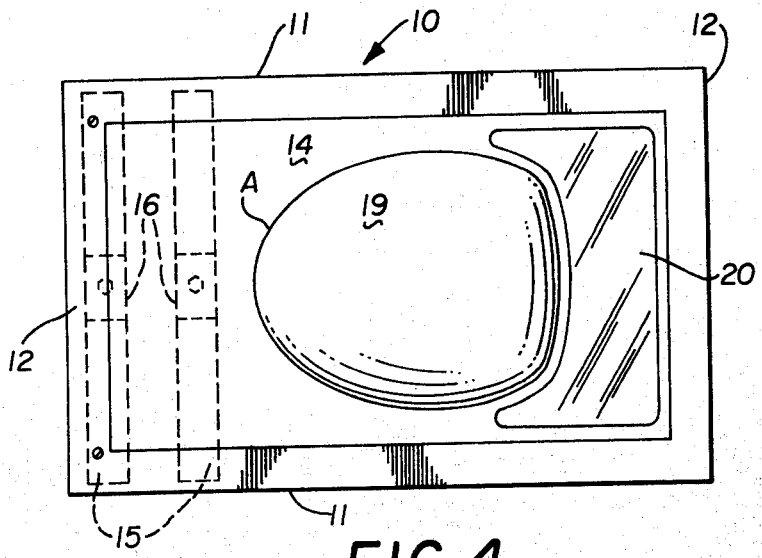
FIG. 4 is a bottom plan view of the luminaire seen in FIG. 3.

In the form of the invention chosen for illustration herein the luminaire will be seen to comprise a housing generally indicated at 10 and comprising oppositely disposed side and end walls 11 and 12, a top 13 and an apertured bottom 14. Broken lines in FIGS. 2, 3 and 4 illustrate transverse support members 15 and clamps 16 by means of which the housing 10 is attached to one end of an elongated arm 17 for support thereby.

Figure 1:
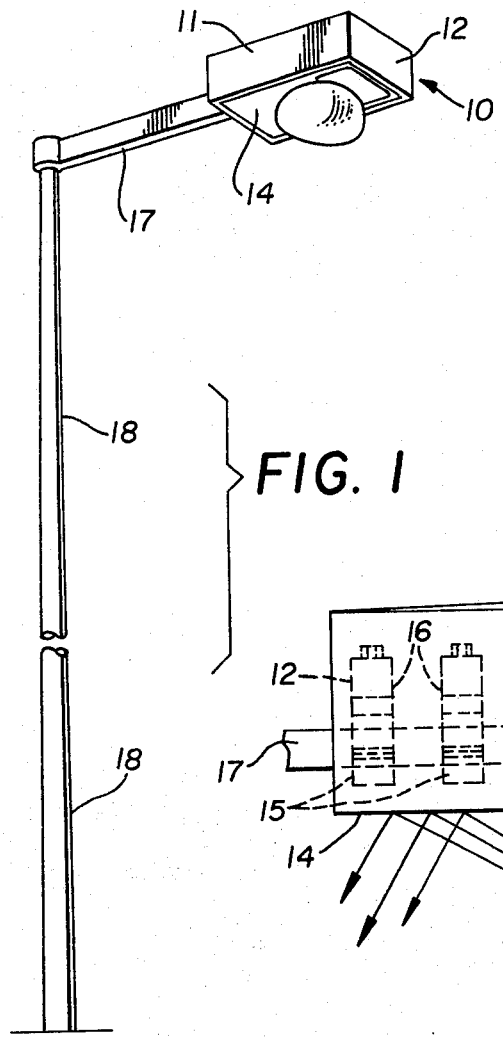
FIG. 1 is a perspective elevation of an area lighting luminaire on a supporting pole and arm with parts of the pole broken away.

By referring to FIG. 1 of the drawings, it will be seen that the elongated arm 17 is engaged at its opposite end on the top of a support pole 18 and it will be obvious to those skilled in the art that a plurality of such arms 17 may support a plurality of the luminaires disclosed herein with respect to a single support pole.

Figure 2:
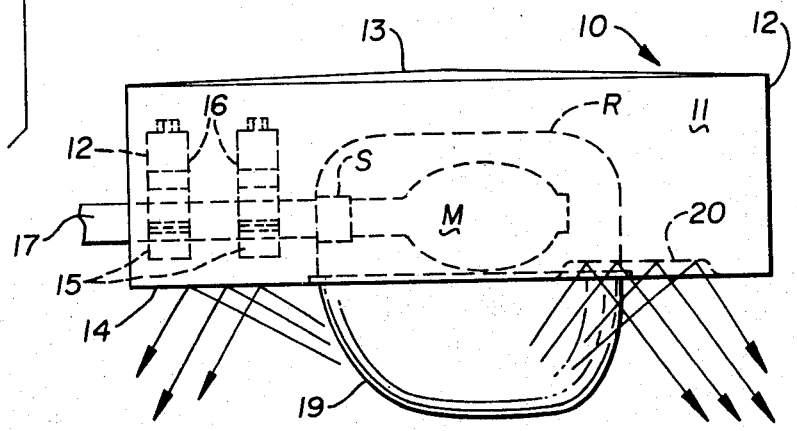
FIG. 2 is a side elevation of the luminaire seen in FIG. 1 in enlarged detail. Arrows in FIG. 2 indicate light reflected from the intercepting zone of the housing.

By referring now to FIG. 2 of the drawings in particular, it will be seen that broken lines indicate a socket S in which a mercury lamp M is positioned within an appropriately shaped reflector R. An ovoidal shaped refractor 19 is positioned in the aperture in the bottom 14 of the housing and extends therebelow. It will further be observed that the upper peripheral edge of the ovoidal refractor 19 registers with the lower peripheral edge of the reflector R so that substantially all the light resulting from energization of the mercury lamp M is directed downwardly from the mercury lamp M and into the refractor 19. The refractor 19 may be any one of a number of refractors formed of light transparent material capable of redirecting light from a light source. Such refractors have systems of regressed prisms on their inner surface and one such suitable refractor may be seen in U.S. Pat. No. 3,350,556.

Those skilled in the art will observe that such refractors direct most of the light from an adjacent light source such as the mercury lamp M in this disclosure outwardly and downwardly with respect to the plane of their upper peripheral edge, which in the present disclosure corresponds with the bottom 14 of the housing 10. In the luminaires heretofor known in the art such light as was directed upwardly and outwardly of the refractor thereby was in effect lost as the luminaires are generally positioned in elevated relation to the area to be illuminated.

By referring now to FIGS. 2 and 4 of the drawings, it will be seen that the bottom portion 14 of the housing 10 which is apertured to receive the upper end of the refractor 19 is provided with at least one recessed reflecting area 20 adjacent the aperture in which the refractor 19 is positioned. In FIG. 2 of the drawings arrows indicate the reflection of upwardly and outwardly directed light from the refractor by the reflecting area 20 formed in the bottom 14 of the housing.

In FIG. 4 of the drawings the bottom view of the luminaire illustrates the apertured bottom 14 in plan view and wherein the aperture is indicated at A and the recessed reflective area 20 will be seen to extend transversely of the bottom portion 14 of the luminaire with portions of the reflective area curving around the aperture A on either side thereof.

Those skilled in the art will observe that if desired a duplicate or similar recessed reflective area can be formed in the bottom 14 of the luminaire on the opposite side of the refractor 19 and that such light as is directed upwardly from the refractor 19 would be reflected downwardly and outwardly thereby. Alternately it may be left transversely flat and formed of polished aluminum or other suitable light reflecting material so that the overall effect of the luminaire when viewed from below is a relatively large area of light rather than a small hot light source.

Those skilled in the art will also observe that refractors of configurations other than that disclosed herein can be employed with the luminaire of the invention and whereby the light now lost upwardly and outwardly therefrom will be redirected outwardly and downwardly by the increased reflective capacity of the luminaire as occasioned by the novel configuration of the portion thereof surrounding the refractor.

It will thus be seen that an area lighting luminaire has been disclosed which results in increased lighting efficiency, the elimination of hot spot lighting and incorporates the structure necessary therefor in an attractive unit.

Having thus described my invention, what I claim is:

1. An area lighting luminaire comprising an enlarged housing with closed side, end and top walls and a bottom wall having an aperture therein spaced with respect to the peripheral edges thereof, a light source and a reflector therefor in said housing and a refractor located in said aperture in said bottom wall and depending therefrom, at least one substantially flat reflective area formed in said bottom wall between the peripheral edge thereof and the refractor and arranged to redirect light from said refractor outwardly and downwardly with respect to the same and means in said housing supporting said light source and mounting said housing on an elevated support.

2. The area lighting luminaire set forth in claim 1 and wherein said housing is rectangular and the bottom wall thereof is apertured midway between the ends and the sides thereof and said reflective area is formed in said bottom wall between the aperture therein and one end thereof.

3. The area lighting luminaire set forth in claim 1 and wherein the area of said bottom wall of said housing is at least double the area of said aperture therein and wherein said bottom wall is formed of light reflecting material.

4. The area lighting luminaire set forth in claim 1 and wherein said refractor is of ovoidal bowl shape with its peripheral edge registering in said aperture in said bottom wall and wherein said reflective area in said bottom wall has a configuration at least partially matching the shape of the ovoidal bowl of the refractor and the aperture in which it is positioned.

5. The area lighting luminaire of claim 1 and wherein the substantially flat reflective area is partially arcuate in transverse section particularly adjacent the peripheral edges thereof.

6. The area lighting luminaire of claim 1 and wherein the refractor has a design directing a relatively large amount of the total light in one direction relative to said housing and wherein the recessed reflective area is formed in the bottom wall of the housing adjacent said relatively large light directing portion of said luminaire.

7. The area lighting luminaire set forth in claim 1 and wherein said housing is rectangular and the bottom wall thereof is apertured midway between the ends and the sides thereof and said reflective area is recessed in said bottom wall between the aperture therein and one end thereof.

* * * * *